US006619882B2

(12) United States Patent
Harvey

(10) Patent No.: US 6,619,882 B2
(45) Date of Patent: Sep. 16, 2003

(54) METHOD AND APPARATUS FOR SEALING CRACKS IN ROADS

(75) Inventor: Rickey Harvey, Columbia, MO (US)

(73) Assignee: RH Group LLC, Columbia, MO (US)

( * ) Notice: Subject to any disclaimer, the term of this patent is extended or adjusted under 35 U.S.C. 154(b) by 4 days.

(21) Appl. No.: 09/901,943

(22) Filed: Jul. 9, 2001

(65) Prior Publication Data

US 2002/0015783 A1 Feb. 7, 2002

Related U.S. Application Data

(63) Continuation-in-part of application No. 09/613,513, filed on Jul. 10, 2000.

(51) Int. Cl.[7] ..... E01C 23/02

(52) U.S. Cl. ..... 404/107; 404/90; 404/108; 404/111

(58) Field of Search ..... 404/107, 108, 404/111, 101, 92, 90, 93

(56) References Cited

U.S. PATENT DOCUMENTS

| | | | | | |
|---|---|---|---|---|---|
| 894,859 | A | | 8/1908 | Southgate | |
| 2,530,777 | A | * | 11/1950 | Middlestadt | 404/107 |
| 2,578,080 | A | * | 12/1951 | Middlestadt | 404/107 |
| 3,020,812 | A | * | 2/1962 | Gross | 404/107 |
| 3,020,813 | A | * | 2/1962 | Gross | 404/107 |
| 3,967,913 | A | | 7/1976 | Gabriel, Jr. | |
| 4,302,128 | A | | 11/1981 | Thatcher | |
| 4,329,081 | A | | 5/1982 | Buvik | |
| 4,502,814 | A | * | 3/1985 | Trimble | 404/107 |
| 4,511,284 | A | | 4/1985 | Sterner | |
| 4,557,626 | A | | 12/1985 | McKay et al. | |
| 4,676,689 | A | | 6/1987 | Yant | |
| 4,678,363 | A | | 7/1987 | Sterner | |
| 4,812,076 | A | | 3/1989 | Yant | |
| 5,006,012 | A | | 4/1991 | Sterner | |
| 5,026,206 | A | | 6/1991 | O'Connor | |
| 5,182,057 | A | | 1/1993 | Johnson | |
| 5,215,403 | A | | 6/1993 | Peterson | |
| 5,232,306 | A | | 8/1993 | Sterner | |
| 5,236,275 | A | | 8/1993 | Kneeland et al. | |
| 5,263,790 | A | | 11/1993 | Bickley et al. | |
| 5,354,145 | A | * | 10/1994 | Sterner | 404/75 |
| 5,362,178 | A | | 11/1994 | Schantz | |
| 5,405,213 | A | * | 4/1995 | O'Connor | 404/77 |
| 5,419,654 | A | | 5/1995 | Kleiger | |
| 5,613,800 | A | | 3/1997 | Kneeland | |
| 5,752,782 | A | | 5/1998 | Hulicsko | |
| 5,765,963 | A | | 6/1998 | Roberts | |
| 5,895,173 | A | | 4/1999 | O'Brien et al. | |

FOREIGN PATENT DOCUMENTS

| | | | |
|---|---|---|---|
| FR | 2530694 | 3/1982 | E01C/23/06 |

* cited by examiner

*Primary Examiner*—Thomas K. Will
*Assistant Examiner*—Alexandra K. Pechhold
(74) *Attorney, Agent, or Firm*—Hovey Williams LLP

(57) ABSTRACT

Roadway crack sealing apparatus (20) which includes a mobile vehicle (26) with a forward crack sealing assembly (22) and a following finishing assembly (24). The assembly (22) includes laterally spaced apart fill and sealant hoppers (30, 36) each equipped with selectively openable outlets (32, 34, 38) and an elongated roadway crack sighting passageway (128) therebetween. The fill hopper preferably has a pair of outlets (32, 34), with the sealant hopper (38) between the latter so that a crack is sealed by sequential application of fill, sealant and additional fill. In use, an operator within the vehicle compartment (162) visually locates a crack (28) through the passageway(128), and steers the vehicle (26) accordingly; the operator also manipulates appropriate controls for selectively opening the outlets (32, 34, 38). The finishing assembly (24) includes a series of lateral brushes which sweep and finish the sealed crack and adjacent roadway.

29 Claims, 8 Drawing Sheets

METHOD AND APPARATUS FOR SEALING CRACKS IN ROADS

CROSS-REFERENCE TO RELATED APPLICATIONS

This application is a continuation-in-part of application Ser. No. 09/613,513, filed Jul. 10, 2000.

BACKGROUND OF THE INVENTION

1. Field of the Invention

The present invention is broadly concerned with improved roadway crack sealing apparatus which comprises a mobile vehicle with a forward crack sealing assembly including respective fill (e.g., sand) and sealant (e.g., asphalt emulsion or cement) hoppers cooperatively located so that the sealing assembly presents a sighting passageway permitting an apparatus operator to visually locate and follow an elongated roadway crack during forward movement of the vehicle. More particularly, the invention pertains to such apparatus and corresponding methods wherein the sealing assembly is designed to initially apply a particulate fill into the crack, followed by sealant and a top coating of additional fill; preferably, a broom-type finishing assembly is also provided.

2. Description of the Prior Art

Roadway cracks are a constant problem to municipal and state transportation authorities. Unless such cracks are rather promptly filled and sealed as weather permits, they may widen into more significant fissures or potholes. Known roadway crack-filling operations typically involve the use of a truck-mounted kettle or tank containing crack-filling material such as an asphalt emulsion. Applicator brushes, swabs or similar expedients may be dipped into the tank and then onto the roadway defects, as the tank is moved along the road. Alternately, some operations use hoses leading from such a mobile tank to an applicator wand which is operated manually to apply crack-filling material into irregular defects or cracks. After the flowable crack filling material is applied, sand or aggregate is generally applied by a following dump truck and workers who shovel and/or brush the sand or aggregate. Such operations are inherently labor-intensive, requiring a crew of four or more workers. Moreover, production rates are typically low, owing to the fact that the rate is only as fast as the slowest crew member.

A number of specialized repair machines have been proposed in the past, see, e.g., U.S. Pat. Nos. 5,232,306, 5,006,012, 5,263,790, 5,419,654, 4,511,284, 4,676,689 and 894,859. In most cases, such equipment is very expensive because it is entirely purpose-built. Hence, while the equipment may be useful during the season where crack sealing operations are most intense, during some seasonal periods the equipment stands idle. Furthermore, these prior proposals have not adequately provided efficient, high speed and high quality crack sealing as they require labor-intensive crack filling and sealing.

There is accordingly a need in the art for improved roadway crack sealing apparatus which can, if desired, be removably mounted upon a multiple-use vehicle such as a skid steer unit, and which allows efficient roadway crack sealing using only a minimum of crew members.

SUMMARY OF THE INVENTION

The present invention overcomes the problems outlined above and provides roadway crack sealing apparatus in the form of a mobile vehicle having a driver compartment with a crack sealing assembly forward of the driver compartment. The sealing assembly includes fill and sealant hoppers each provided with selectively openable outlets for application of fill and sealant onto roadway cracks. The sealing assembly presents spaced side margins and is configured to create an elongated sighting passageway therebetween allowing an operator within the compartment to visually locate and follow an elongated roadway crack during forward movement of the vehicle along a roadway. Furthermore, in preferred forms, a control assembly coupled with the fill and sealant outlets is mounted adjacent the driver compartment so that the driver (or an operator separate from the driver) can continuously manipulate and control the quantity of fill and sealant delivered for crack sealing purposes.

In preferred forms, the fill and sealant hoppers are laterally spaced apart and astride the sighting passageway. The fill hopper advantageously has a pair of spaced, individually controllable outlets, whereas the sealant hopper has a single nozzle-type outlet between the fill hopper outlets. In this way, fill is first deposited into the crack, followed by sealant and then more fill. A drag element is advantageously located proximal to these outlets so that the crack filling materials are properly applied and smoothed during forward motion of the vehicle.

The preferred crack sealing apparatus also includes a finishing assembly which is towed by the vehicle. The finishing assembly has a series of laterally arranged brushes serving to finally brush and finish the crack repair. A rear platform supports a crew member who can manually sweep away any excess fill material and otherwise monitor the progress of the crack sealing operation.

In order to facilitate over the road travel, the forward sealing assembly is equipped with a castered wheel assembly, while the finishing assembly may be moved to an upright, retracted position.

In particularly preferred forms, the apparatus is adapted for connection to a uniloader or skid steer. These types of vehicles are versatile and mobile in all directions and particularly adapted for following cracks which may extend in any direction. The apparatus further comprises one hopper which is adapted to hold a quantity of emulsion and a second hopper which is adapted to hold a quantity of fill material. The emulsion-containing hopper is spaced from the sand-containing hopper such that there is a visible channel between the two hoppers. The fill-containing hopper presents two adjustable doors located near the bottom of the hopper. The doors are laterally spaced apart and have chutes attached thereto for directing the fill material toward cracks in roads. Furthermore, each chute is directed the channel between the two hoppers. At the end of each chute is a second door which meters the amount of sand exiting the chute and deposited in and around the crack being sealed. Although each door is depicted as being manually operable, it is within the realm of the invention to have doors which are operated in other ways including electrically, pneumatically, and hydraulically. Generally, once the hopper is filled with the fill material, each first door leading from the hopper to the chute is opened and left in an open position. This permits the fill to flow from the hopper onto the chute where it is normally retained by each second door which are normally in a closed position. Potential fill materials include manufactured limestone sand, rock chips, gravel, sawdust and wood chips. The use of manufactured limestone sand and sawdust are particularly preferred as the fill materials of choice. In preferred embodiments, the second hopper is also equipped with a castered wheel attached to the bottom of the apparatus. This wheel accommodates some of the weight of the hopper and permits a turning radius approximating zero.

The emulsion-containing hopper includes an outlet leading to a specially designed nozzle located in the channel between the two hoppers. This nozzle is further located between the two chutes of the second hopper. The output of emulsion through the nozzle is controllable by a valve which is operable for varying the emulsion output. Operation of the valve is controlled by the operator of the apparatus. The nozzle is designed to apply emulsion over the top of the crack and onto the sides of the crack, thereby sealing the crack by providing a strip of emulsion which covers the crack and both sides adjacent the crack. The width of this emulsion strip is determined by the width of the nozzle and by a set of squeegees on an emulsion drag. Generally, the nozzle receives emulsion from the emulsion containing hopper. The inflow port of the nozzle is generally round in shape in order to facilitate attachment to a conduit leading to the emulsion tank. The nozzle then presents a channel of diminishing cross sectional area up to the tip (or outflow port) of the nozzle terminating in a slit-shaped outflow port. This slit-shaped outflow port is preferably wider than the cracks to be filled when oriented transversely to the cracks. Such a design permits a strip of emulsion to be applied both to the crack and to the area adjacent the crack. It is contemplated that in some embodiments, the nozzle could be connected to a mobile or swing arm which is controlled by the skid steer operator. Such an arm would provide even greater maneuverability of the nozzle so that cracks can be closely followed and sealed.

The nozzle is also unique in that it is surrounded by a conduit which is in communication with the exhaust port of the skid steer. The connection to the exhaust output serves two purposes; first, the exhaust heats the emulsion immediately prior to its application to the crack, second, the air flow from the exhaust serves to blow away dust and debris from the area adjacent the crack, thereby providing an improved surface for emulsion application.

The apparatus is preferably provided with a series of drags or drag brooms which strike and smooth the sand deposited in the crack. These drag brooms can be located in a variety of places but are preferably located after the first chute but before the nozzle and after the second chute, located behind the skid steer.

In order to facilitate the operation of the apparatus, at least one labor stand is provided. It is preferable to have one labor stand which is adjacent the second hopper such that a worker positioned on the stand has a view of and access to the sand-containing hopper. In this manner, the worker can agitate the fill material therein and thereby ensure that the flow of sand to the chutes is unobstructed. Of course, it is within the scope of this invention to provide a mechanical agitator in the sand-containing hopper rather than using a worker. It is also preferable to locate a second labor stand near the second series of drag brooms which are preferably located behind the skid steer apparatus. The second labor stand is operable for supporting a worker who monitors the crack sealing operation and sweeps away any excess fill material which has been swept away from the sealed crack by the drag brooms. In order to increase safety, the apparatus can be equipped with a safety latch bar to which workers wearing a safety harness or belt can attach themselves.

It is also preferable for the apparatus to have at least one mirror positioned to reflect the channel and the components located therein to the operator of the apparatus. In this manner, the skid steer operator can sight a crack and, using the maneuverability of the skid steer, closely follow the crack contour as it is sealed. A second mirror can be positioned such that the worker located on the labor stand adjacent the sand-containing hopper can monitor the operation of the crack sealer.

In operation, the operator of the skid steer is driving forward and the portion of the apparatus comprising the two hoppers and the channel is located in front of the operator. The operator then sights a crack and positions the apparatus such that the crack is visible through the channel and located adjacent the chutes and nozzle. The second door of the first chute is then opened and sand from the hopper which has already passed through the first door leading to the first chute is deposited into and around the crack. The first series of drag brooms then strikes the level of this deposited sand off level with the sides of the crack. Next, the valve controlling the emulsion application is opened and emulsion is applied over the top of the crack and onto the sides of the crack. The second door at the end of the second chute is then opened allowing sand which has already passed through the first door leading to the second chute to be deposited on top of the strip of emulsion. A second series of drag brooms then strikes this second layer of sand off at a preset level which is either even with the sides of the crack or slightly higher than theses sides. In instances where the sand is left at a higher level by the second series of drag brooms, traffic passing over the sand hump will compress the mixture of sand emulsion into the crack and "iron" the crack sealing material onto the sides of the crack, thereby providing a greater seal for the crack. Alternatively, if you want to fill cracks, an entirely different nozzle will be employed. This alternative nozzle will deposit a much greater amount of emulsion into the crack. Accordingly, less fill material would be deposited into the crack when using such a nozzle.

As shown in the drawings, the apparatus is positioned such that the channel is located to the right of the skid steer operator and thus is efficient at filling cracks located on the right-hand side of a roadway. Such an apparatus may also fill cracks which are located more toward the center or left-hand side of the roadway, however, in such cases, the apparatus can be designed to more efficiently fill such cracks. For example, the channel could be positioned to the left of the skid steer operator by merely switching the positions of the fill-containing hopper and the emulsion-containing hopper. Alternatively, the apparatus can be built in this manner. In all cases, the operation remains the same regardless of where the channel is positioned. Thus, all such variations in the construction of the apparatus are embraced in the present invention.

It is preferable to use an emulsion which is quick setting and has both adhesive and elastic properties. Preferably, the emulsion used is CRS2 for asphalt or CRS2-P for concrete, either of which can be further modified by the addition of polymer. This elasticity and adhesiveness provides the enhanced ability of this crack sealing material to stick to the sides of the crack and provide a long-lasting seal.

It is preferable in some situations to merely fill or seal the crack with emulsion and not use any fill material. In such cases, the fill-containing hopper is either not used or removed from the apparatus entirely. Of course, an apparatus could be built with just an emulsion-containing hopper, however, for ease of illustration and convenience of use, it is preferable for the apparatus to include both hoppers.

Other useful accessories for the apparatus include a spray mister, a heating or insulating mechanism for the emulsion tank, a substrate heater, and a cover for the fill-containing hopper. Preferably, the spray mister would be located between the first hopper door and the emulsion nozzle which can provide a fine spray of soapy water (which improves the performance of the emulsion) in front of the emulsion nozzle to dampen the dust and surface of the road thereby permitting the emulsion to soak through the dust and in through the cracks and adhere to the road. The heating or insulating mechanism for the emulsion tank would permit emulsion to be stored in the tank for greater periods of time prior to the emulsion setting. For example, an electric heater or electric blanket could be used in conjunction with the emulsion tank. In the case of applications using hot-pour tar, the heating mechanism would preferably comprise burners adapted to heat the oil, melt the tar, and to prevent the same from setting in the tank or dispensing apparatus. The substrate heater would typically be located in front of the emulsion nozzle and could be used during wet or cold weather conditions to heat and at least partially dry the sidewalls of the crack, thereby improving the conditions for emulsion adhesion. When using wood chips or sawdust as the fill material, the fill-containing hopper may be equipped with a removable or openable top. Such a top would keep the wood chips and saw dust dry during inclement weather. Preferably the top would be adapted through arching or the like such that a laborer could continue to ensure consistent movement of the material into the chutes when the hopper was not equipped with a mechanical agitator.

Advantageously, the preferred apparatus is designed such that the crack sealer may be driven up to the back of a dump truck with either a center or under gate attachment thereby allowing the dump truck to deposit fill material directly into the sand-containing hopper. Therefore, no additional labor is required to fill the hopper with sand.

Of course, the apparatus can be manufactured to accommodate any amount of fill material and emulsion. For example, a 2000 pound lift skid steer may be attached to an apparatus holding about 600 pounds of fill material and 50 gallons of emulsion. Larger or smaller vehicles or skid steers which hold larger or smaller amounts of crack sealing materials may be employed as desired.

Thus the present invention overcomes the problems in the field and provides an efficient, easily operable and maintainable crack sealing apparatus. Using the present invention, 31.34 miles of road were repaired in 95.5 hours using a six man crew (approximately 0.33 miles of road/hour). Using the previously known conventional crack sealing methods, 3.8 miles of roads were repaired in 120 hours using another six man crew (approximately 0.032 miles of road/hour). Thus the present invention provided a ten-fold increase in efficiency. Furthermore, using the present invention, the sealed cracks should last longer and be more durable due to the application of emulsion in the crack and along the sides of the crack.

DETAILED DESCRIPTION OF THE PREFERRED EMBODIMENT

Figure 1:
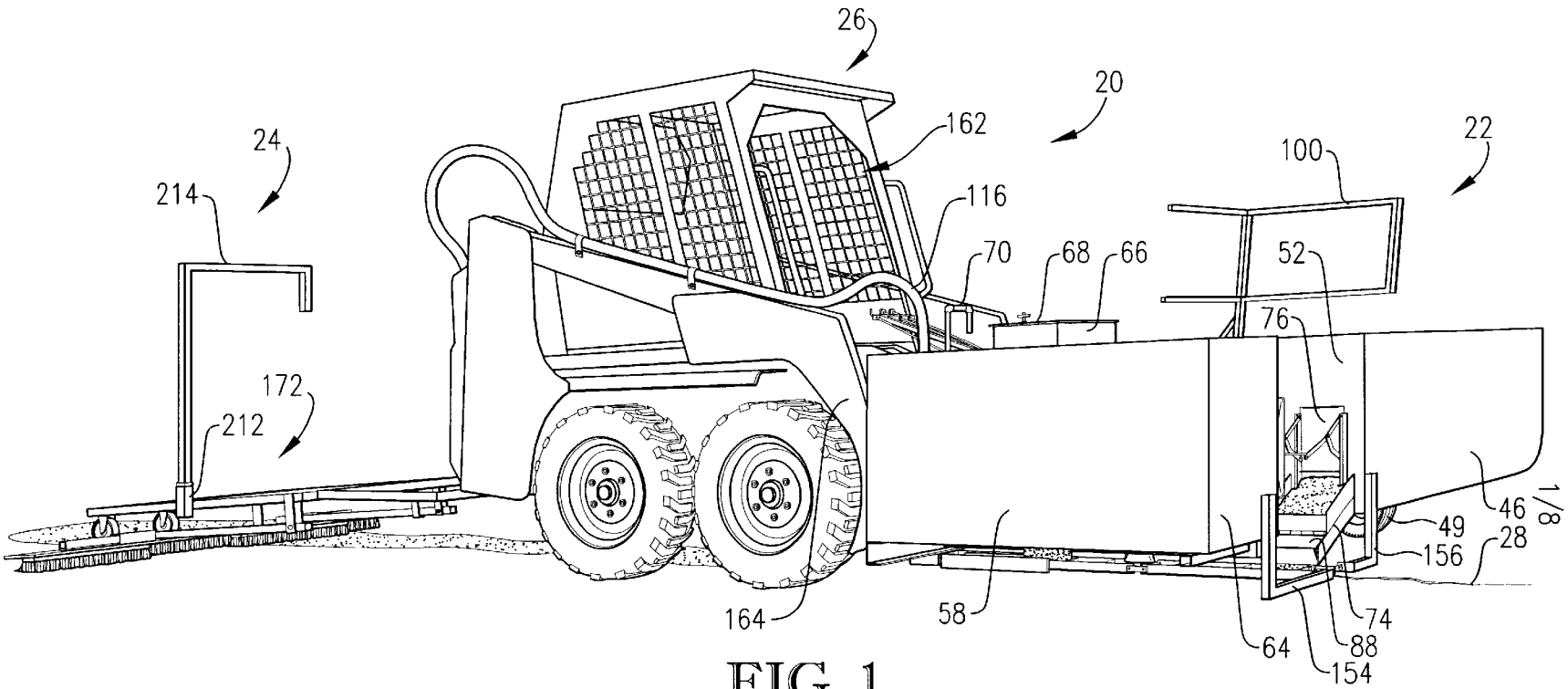
FIG. 1 is a perspective view of the preferred crack sealing apparatus.

Turning now to the drawings, a preferred roadway crack sealing apparatus 20 is illustrated in FIG. 1 and includes a forward sealing assembly 22, a trailing, broom-type finishing assembly 24 and an intermediate vehicle 26. The apparatus 20 is designed for the fast and efficient sealing and finishing of elongated roadway cracks such as the crack 28 depicted in FIGS. 1 and 9–11. A particular feature of the apparatus is that a driver within the vehicle 26 can maintain sight of the crack 28 as the apparatus proceeds down a roadway, and can also control the operation of the sealing assembly 22 from the driver compartment. In this manner, extensive crack sealing and finishing can be accomplished per hour of use.

In more detail, the forward sealing assembly 22 broadly includes a fill hopper 30 equipped with a pair of spaced apart, selectively openable outlets 32 and 34, together with a sealant hopper 36 having a selectively openable sealant outlet 38. A typical fill material within hopper 30 is particulate sand 40, whereas the sealant hopper 36 commonly is filled with a hot asphalt emulsion 42 (such as CRS2).

Figure 5:
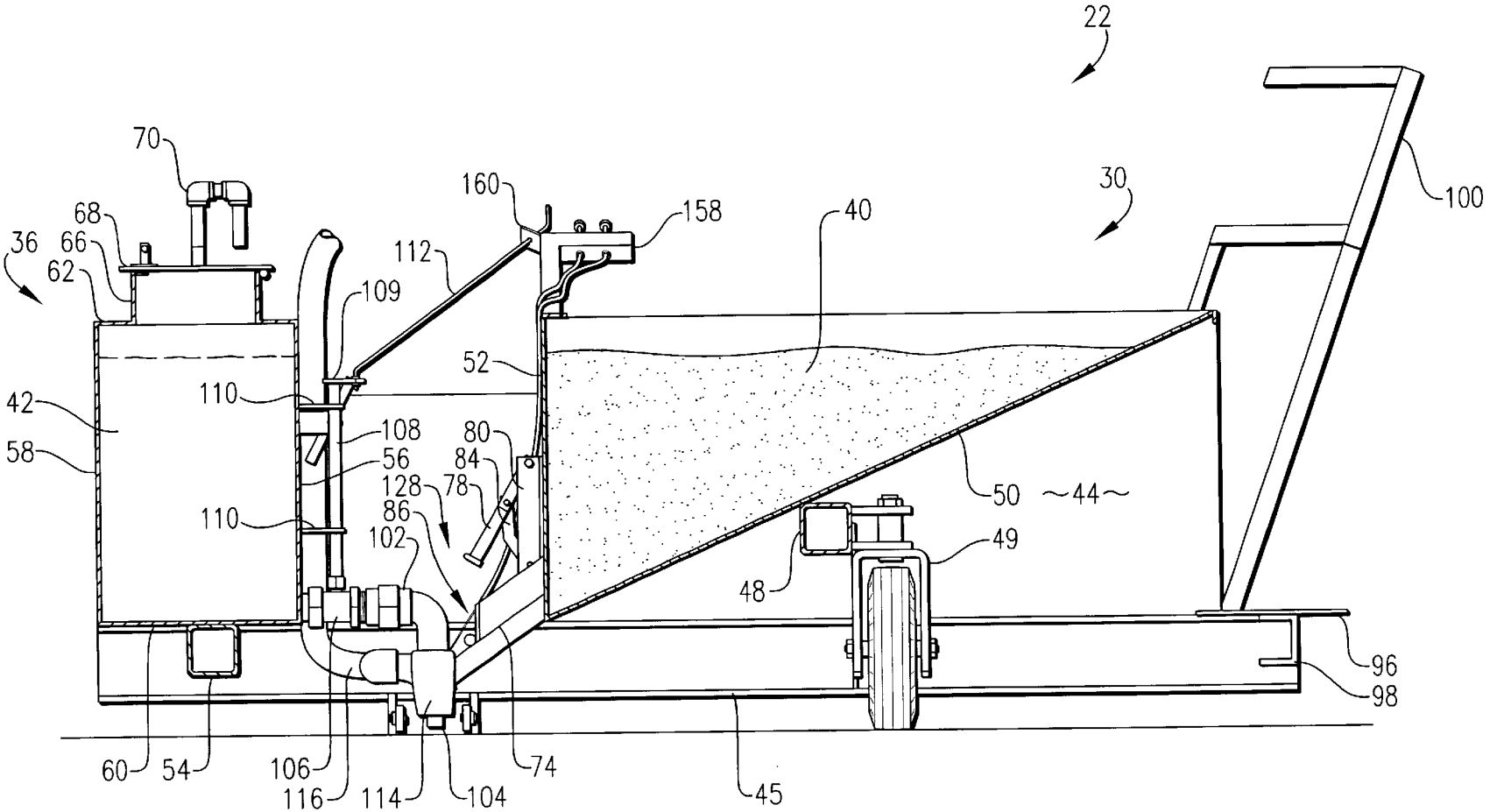
FIG. 5 is a vertical sectional view taken along line 5—5 of FIG. 3.
Figure 7:
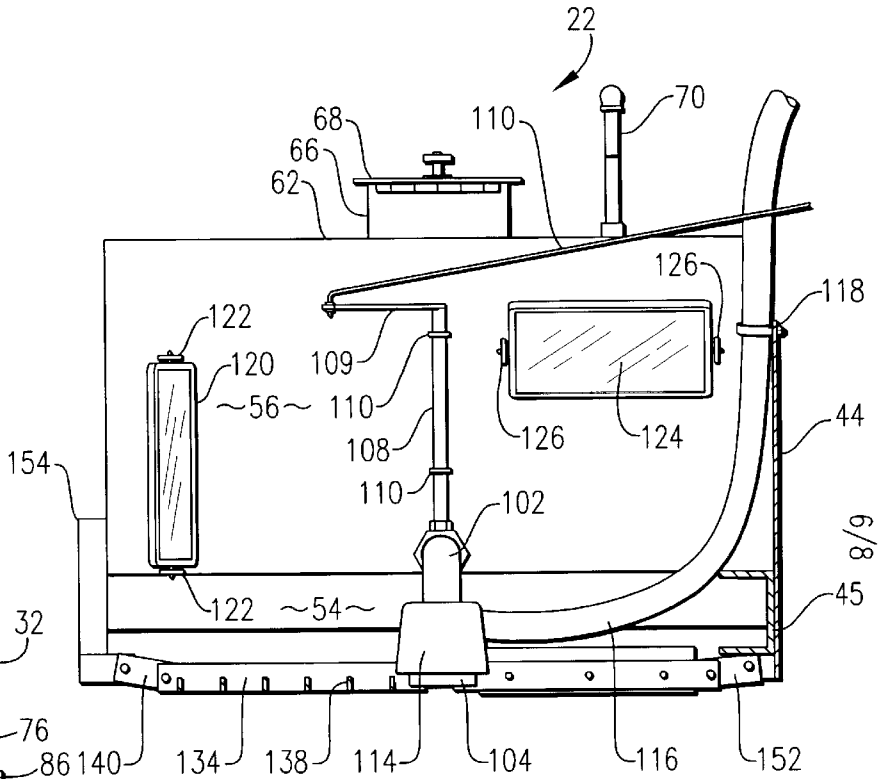
FIG. 7 is a vertical sectional view taken along line 7—7 of FIG. 3.

The overall sealing assembly 22 includes a back plate 44 having a laterally extending, lower reinforcing channel 45 welded thereto, a front plate 46 and a fore and aft extending frame tube 48 connected between the plates 44, 46; a castered road wheel assembly 49 is connected to the tube 48 and supports the sealing assembly 22 for travel over a roadway. In addition, an oblique fill hopper bottom wall 50 and inner sidewall 52 extend between the front and rear plates 44, 46 as best seen in FIG. 5. Accordingly, the front and rear plates 44, 46, together with the sidewall 52 cooperatively define the fill hopper 30. Another frame tube 54 is welded to and extends forwardly from channel 45 and supports the upright, rectangular in cross section sealant hopper 36, the latter including inner and outer sidewalls 56, 58, bottom wall 60, top wall 62 and front wall 64. As shown, the top wall 62 is equipped with an upstanding tubular inlet 66 surmounted by a hingedly connected cover 68. Additionally, an upstanding, u-shaped vent pipe 70 is affixed to top wall 62 and communicates with the interior of the hopper 36.

Figure 6:
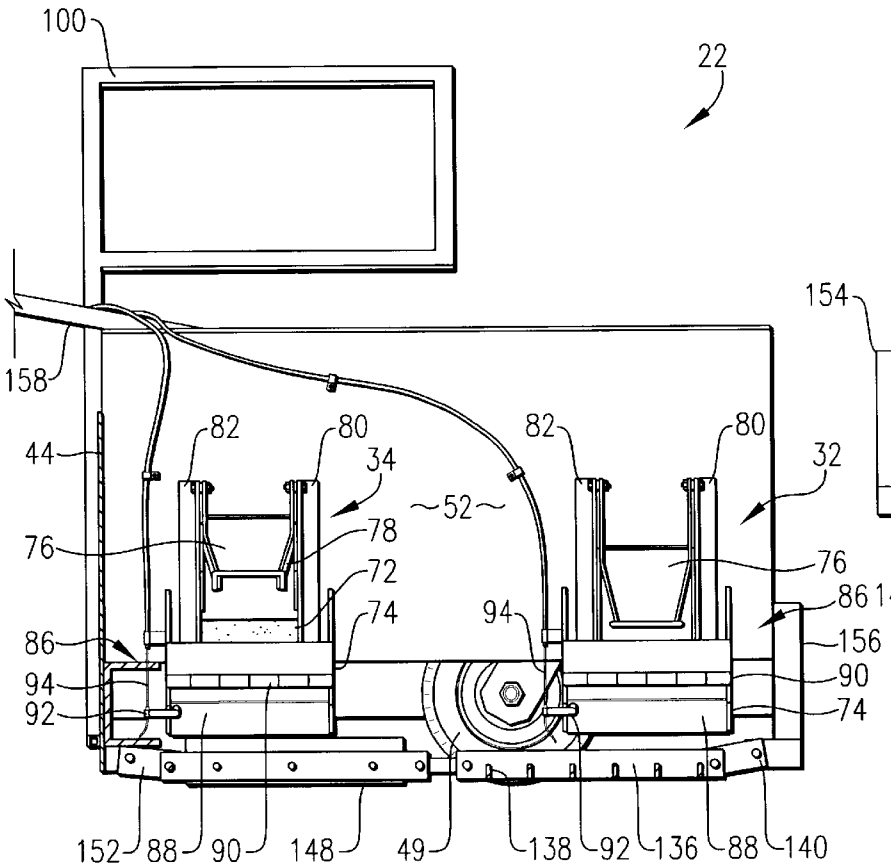
FIG. 6 is a vertical sectional view taken along line 6—6 of FIG. 3.

The fill hopper outlets 32 and 34 are identical and mounted on the fill hopper's inner sidewall 52. Each outlet includes an opening 72 formed through the sidewall 52, with an obliquely downwardly extending chute 74 adjacent the opening 72. The opening 72 is covered by a gate 76 disposed above the chute 74. The gate 76 is selectively movable between a lowered position (see outlet 32, FIG. 6) and a raised position (see outlet 34, FIG. 6). The respective gates 76 are selectively movable between the lowered and raised positions thereof by means of a manual crank 78. In particular, each crank 78 includes a pair of upright angles 80, 82 welded to plate 52 on opposite sides of a corresponding opening 72. The angles pivotally support the crank 78, which is also coupled via legs 84 with the associated plate 76. Hence, manual manipulation of the cranks 78 between the exemplary gate open and gate closed positions shown in FIG. 6 permits the user to open each outlet for passage of fill therethrough as desired.

Each outlet 32 also includes also includes a fill metering assembly 86 which is mounted adjacent the lower end of each chute 76. Each metering assembly includes a plate 88 which is pivotally coupled to the chute by means of hinge 90. Each plate 90 in turn supports a cable connector 92. A control cable 94 is secured to each connector 92 and extends rearwardly as will be further described. The purpose of the metering assemblies 86 is to control the flow of particulate fill from each chute 74 when the associated gates 76 are in their upper positions.

A sideman platform 96 is secured to the right hand margin of channel 45 as illustrated in FIG. 5. The platform 96 is also supported by a forwardly extending channel 98 coupled with primary channel 45. The platform 96 is sized so as to permit a person to stand thereon and monitor the operation of fill hopper 30 as will be further described. An upstanding grab bar 100 is also secured to the rear face of channel 45. The grab bar 100 is configured so that a sideman standing on platform 96 can grasp the grab bar and steady his position.

Figure 11:
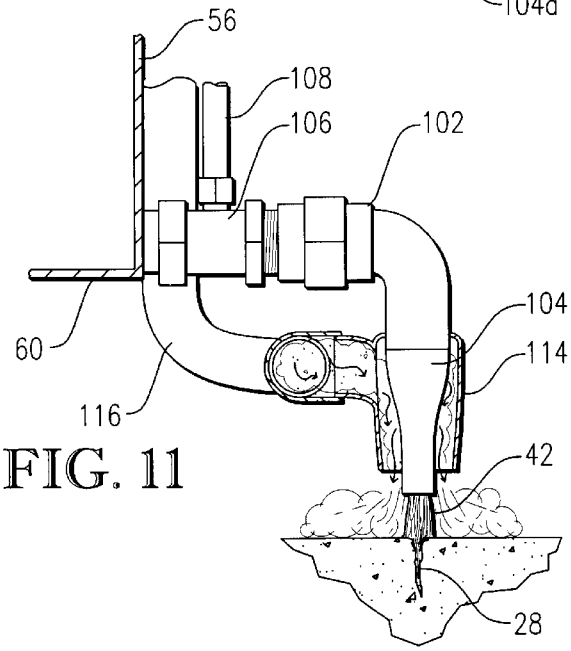
FIG. 11 is a front view of the sealant delivery assembly depicted in FIG. 10.
Figure 10:
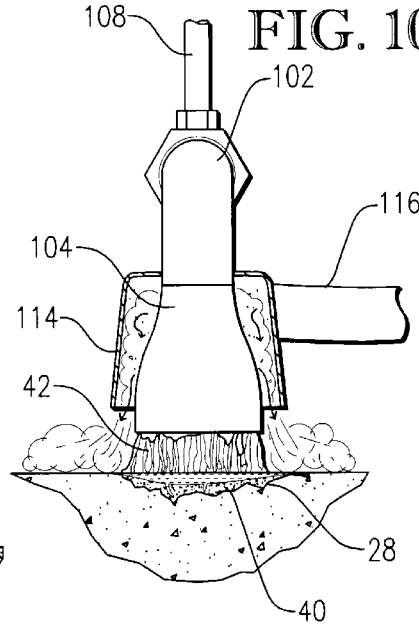
FIG. 10 is a side view of the sealant delivery assembly shown during application of flowable sealant into a roadway crack, depicting the flow of hot exhaust gases around the delivery nozzle.

The sealant outlet 38 is in the form of a piping elbow assembly 102 which is in communication with the interior of the hopper 36 and projects from the base of sidewall 56 terminating in a lowermost, downwardly opening nozzle 104 (FIGS. 10–11). The assembly 102 includes an in-line on-off valve 106 having an upstanding, rotatable valve operator rod 108 having an uppermost rigid arm 109. The rod 108 is supported for axial pivoting movement by means of a pair of vertically spaced apart brackets 110 affixed to wall 56. The operator 108 is selectively movable through the medium of control rod 112 connected to the outer end of arm 109 and extending rearwardly therefrom.

The nozzle 104 is surrounded by a hollow shroud 114 secured to the elbow assembly 102. An arcuate flexible conduit or pipe 116 is in communication with shroud 114 and extends upwardly to a connection bracket 118 secured to back plate 44. The pipe 116 extends rearwardly from the bracket 118 and along the length of vehicle 26. The rearmost end of the pipe 116 is connected to the exhaust pipe (not shown) of the vehicle 26. In this fashion, hot exhaust gases are directed into the shroud 114 so as to assist in heating of the emulsion 42 as will be described hereafter.

The inner sidewall 56 supports a first, vertically extending driver mirror 120, the latter being affixed by means of upper and lower brackets 122. In addition, a second, horizontally extending, sideman mirror 124 is also secured to the wall 56 rearwardly of the mirror 120; the horizontal mirror 124 is likewise supported by end brackets 126.

It will be observed that the fill and sealant hoppers 30, 36 are laterally spaced apart so as to define therebetween an elongated sighting passageway 128. The passageway 128 allows an operator within vehicle 26 to see the roadway, and particularly an elongated crack 28 therein. In this fashion, the operator may steer and guide the apparatus 20 along the length of the crack for sealing purposes. It will be appreciated that the mirror 120 is oriented to facilitate such sighting through the passageway 128. The sideman mirror 124, on the other hand, is oriented so that a sideman standing on platform 96 may observe the flow of fill material from the hopper 30, and especially through rear outlet 34. Also, the sideman mirror allows monitoring of the application of emulsion.

Figure 8:
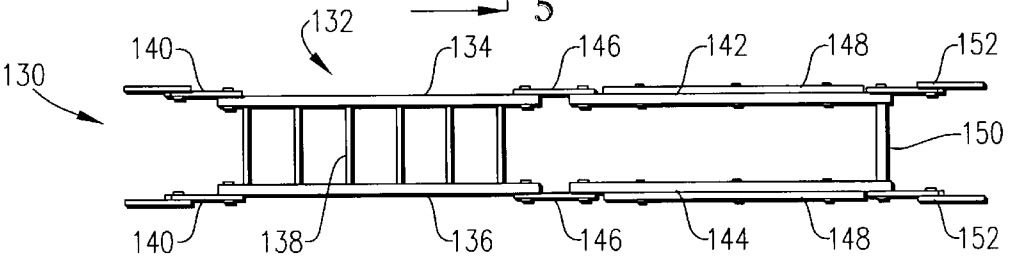
FIG. 8 is a plan view of the preferred ladder-type drag element forming a part of the crack sealing apparatus.
Figure 4:
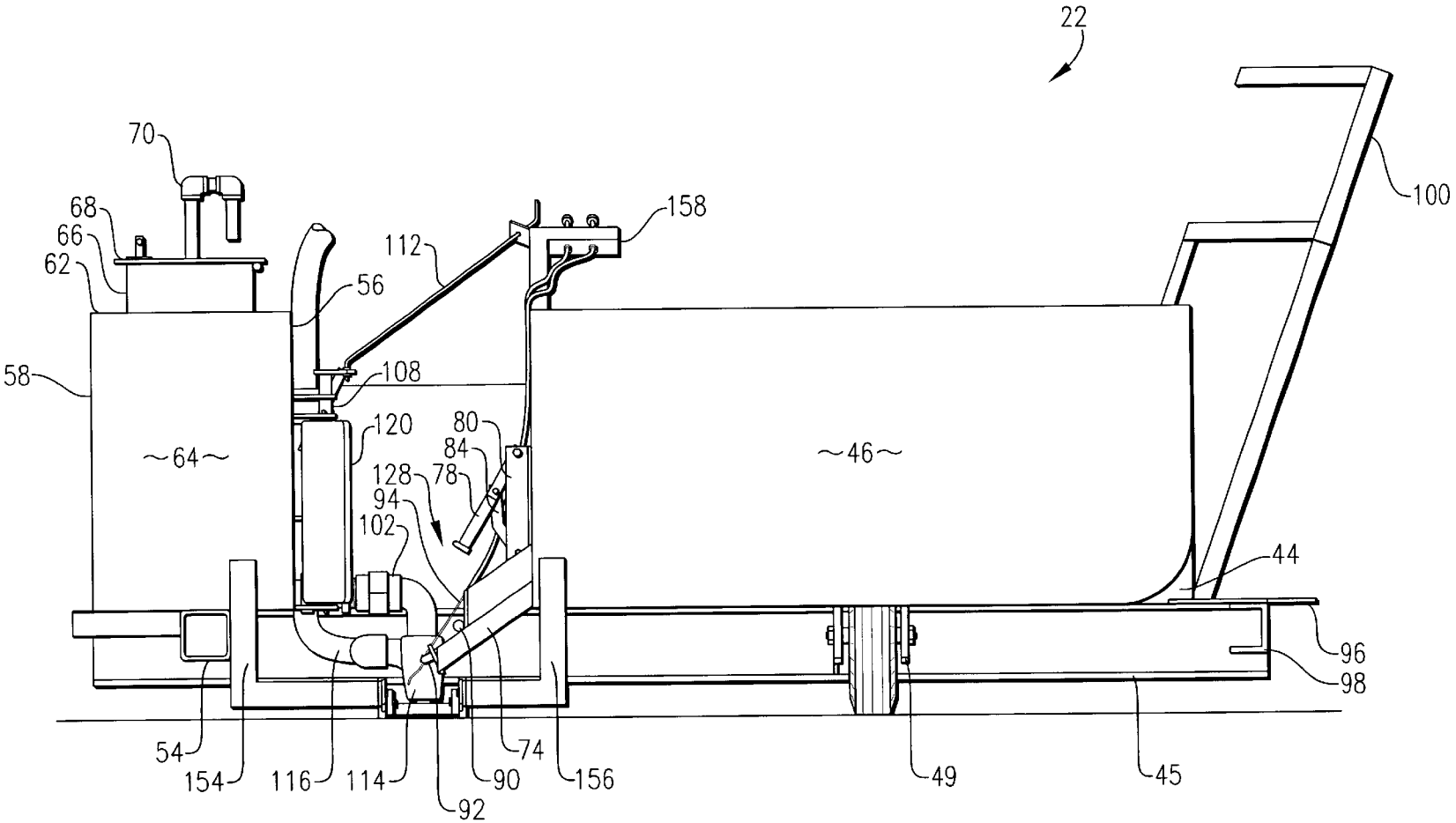
FIG. 4 is a front elevational view of the crack sealing apparatus.

A leveling element 130 is supported on the sealing assembly 22 between the fill and sealant hoppers 30, 36. As best illustrated in FIG. 8, the element 130 includes an elongated ladder 132 presenting side rails 134, 136 and cross rails 138. Elongated pivotal couplers 140 are secured to the forward end of ladder section 132. A pair of elongated followers 142, 144 are pivotally coupled to the trailing end of ladder section 132 via links 146. Each follower 142, 144 includes a resilient, replaceable roadway-engaging drag member 148. A cross member 150 interconnects the followers 142, 144 adjacent the rear end thereof. Finally, a pivotal coupler 152 is secured to each end of the followers 142, 144. The leveling element 130 is supported at the forward end thereof by means of a pair of L-shaped supports 154, 156 respectively secured to and depending from the walls 46 and 64. The front couplers 140 are secured to the inner ends of the supports 154, 156, whereas the rear couplers 152 are affixed to channel 45.

Figure 3:
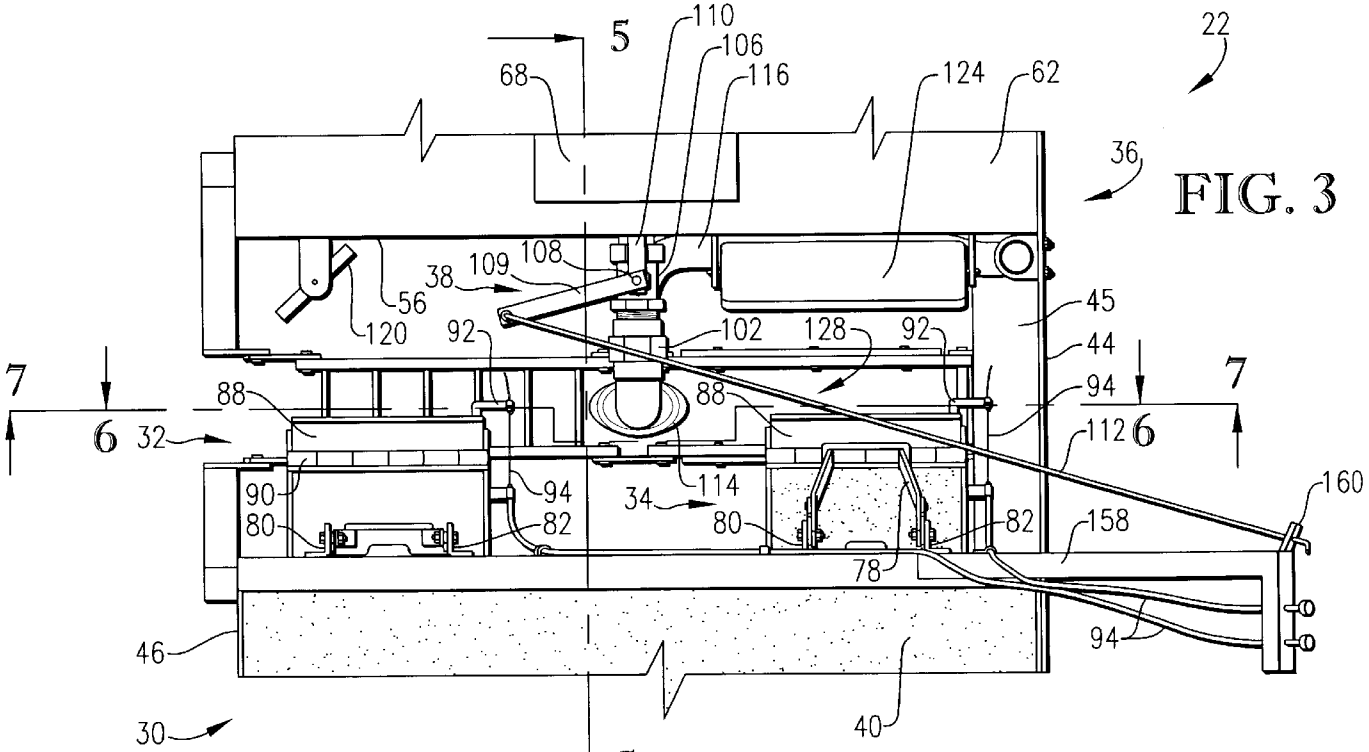
FIG. 3 is a fragmentary top view of the forward section of the crack sealing apparatus, illustrating the fill outlets and intermediate sealant delivery assembly.

Referring to FIG. 3, it will be seen that an L-shaped control mount 158 is welded to the upper margin of sidewall 52 and extends rearwardly and obliquely therefrom. The metering control cables 94 respectively associated with each plate 90 extend backwardly to and are secured to the mount 158. Likewise, the control rod 112 is secured to an apertured tab 160 secured to the mount 158. As will be explained in more detail, the provision of the cable ends and the control rod 112 at this location permits an operator within the vehicle 26 to control the operation of the sealing apparatus during use.

The vehicle 26 in the illustrated embodiment is a conventional skid steer vehicle presenting a driver compartment 162 as well as pivotal operating arms 164, 166 astride the compartment 162. The operating arms are secured to the sealing assembly 22 so that the latter may be moved in any direction upon corresponding movement of the vehicle. The vehicle also has a rearmost apertured draw bar 168 which is important for purposes to be described. While a skid steer vehicle has been shown and is preferred, it will be appreciated that any type of road worthy vehicle of sufficient robustness could be used. By the same token, the overall sealing apparatus 20 could be fabricated as a self-contained and self-propelled unit.

Figures 14, 15:
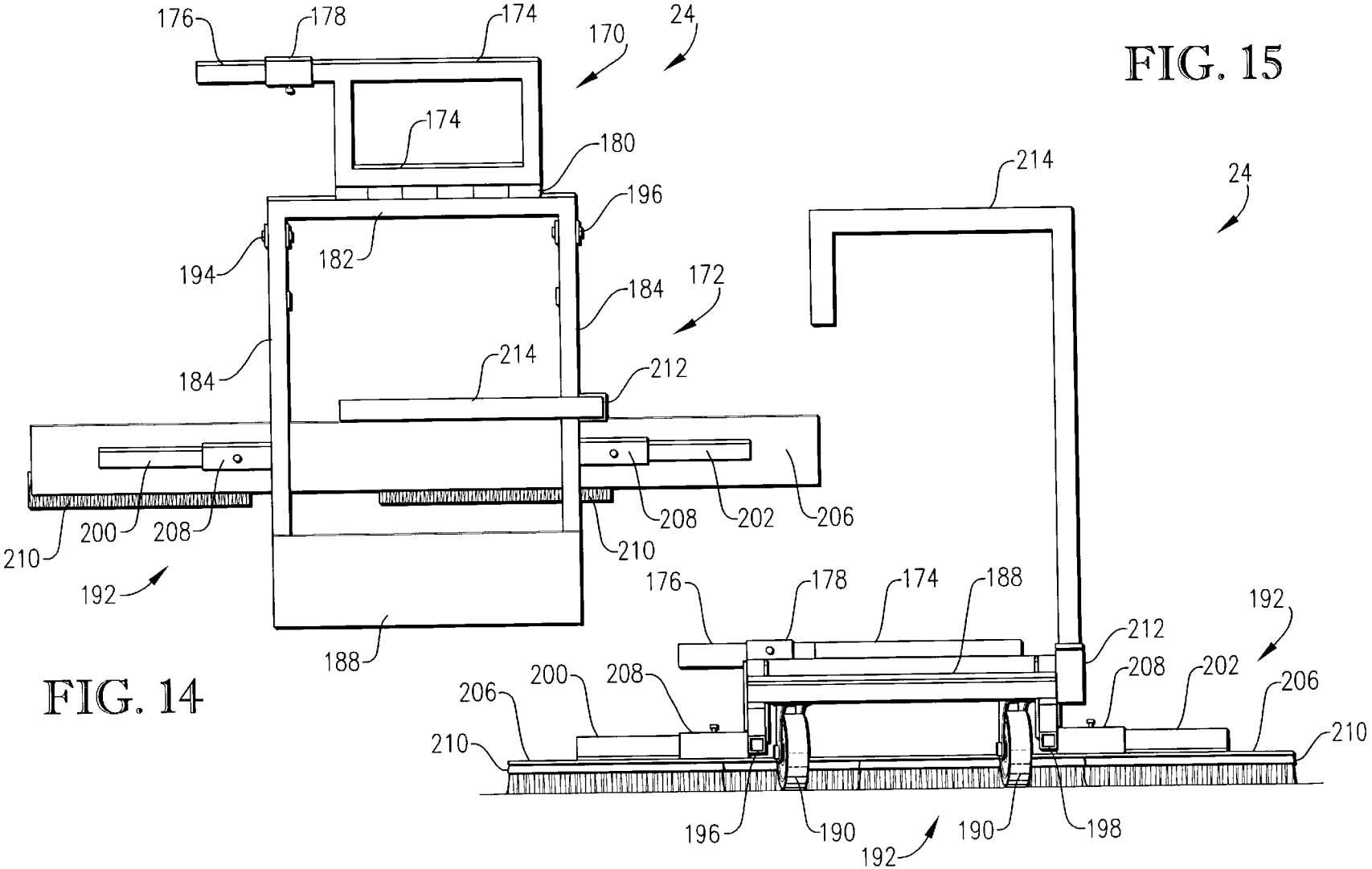
FIG. 14 is a plan view of the trailing broom section forming a part of the crack sealing apparatus.
FIG. 15 is a rear view of the broom section.

The finishing assembly 24 includes a forward connection frame 170 and a trailing operator frame 172 (FIG. 14). The connection frame is formed of interconnected square tubular members 174 and includes a projecting leg 176. The leg 176 is sized to fit within an opening in draw bar 168 so as to connect the assembly 24 to the vehicle 26. For this purpose, a removable collar 178 is provided with leg 176 so that the draw bar may be captively retained between the collar 176 and the adjacent frame member 174.

The operator frame 172 is secured to the trailing end of frame 170 through a hinge 180, allowing the operator frame to pivot about a horizontal axis. The operator frame includes front rail 182, side rails 184 and rear rails 186. An operator platform plate 188 surmounts the rails 184, 186 and provides a standing platform. A pair of rear caster wheel assemblies 190 are affixed to the rear of the frame 172. A brush assembly 192 is supported beneath the frame 172. Specifically, a pair of depending pivot brackets 194 are secured to the forward ends of the side rails 184 adjacent front rail 182. These brackets 194 support rearwardly extending legs 196, 198, the latter having laterally outwardly projecting extensions 200, 202. A pair of keepers 204 are secured to the side rails 184 and depend therefrom, in order to limit the range of movement of the legs 196, 198.

An elongated, laterally extending brush plate 206 is adjustably connected to the extension 200, 202. That is, the plate 206 has a pair of attachment collars 208 secured to the upper surface thereof, these collars 208 receiving the extensions 200, 202 as best seen in FIG. 14. The brush plate has a series of staggered, roadway-engaging brushes 210 releasably secured to the underside thereof.

A square tubular socket 212 is welded to the right hand side rail 184 as illustrated in FIG. 14. The socket 212 is adapted to receive a grab bar 214 of inverted, generally L-shaped configuration. The grab bar 214 may be grasped by an operator standing on platform plate 188 as the apparatus 20 proceeds along a roadway during crack sealing operations.

Operation

The use of apparatus 20 for the sealing and finishing of elongated roadway cracks can best be understood by a consideration of FIGS. 1, 3–5 and 14. The apparatus 20 normally has a crew of three, namely, a driver within the compartment 162 (it being understood that a given vehicle may be large enough to accommodate a driver and a separate operator), a sideman standing on platform 96, and a finishing operator standing on platform plate 188. Before any crack sealing operation is commenced, the sealant hopper 36 is filled with hot emulsion, the fill hopper is filled with a selected material such as sand, and the sideman opens the respective gates 76 associated with the fill outlets 32 and 34. This condition is illustrated at outlet 34 in FIG. 3. However, the sideman does not normally operate the metering assembly 86, but is stationed on the platform 96 in order to insure that fill within the hopper 30 evenly flows through the spaced outlets 32 and 34.

Figure 9:
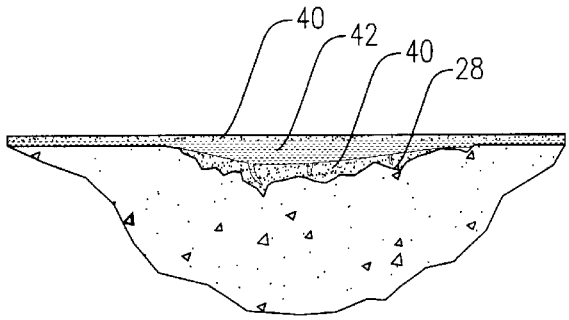
FIG. 9 is a fragmentary sectional view illustrating a filled roadway crack.

As the driver within compartment 162 proceeds down a roadway and locates an elongated crack 28, the latter is sighted through the passageway 128, making use of mirror 120. As the end of the crack is approached, the driver manipulates the control cables 94 and the rod 112 so as to cause fill from the outlet 32 to first flow into the crack 28, followed by sealant from the nozzle 104 and thereafter fill from the rearmost outlet 34. As best seen in FIG. 9, this creates a crack seal made up of bottom most fill 40, sealant 42 and a top layer of fill 40. The driver or operator can precisely control the application of the fill and sealant to achieve an optimum seal. The leveling element 130 serves to level the fill originally deposited via forward outlet 32, the cross rails 138 of the ladder section 132 performing this function. Also, the resilient drag members 148 in contact with the roadway control the width of the seal, i.e., the flowable sealant cannot pass laterally beyond these drag members. Finally, the rearmost cross rail 150 strikes off any excess sealing materials at a preset height.

Referring to FIGS. 10–11, it is preferred that the nozzle 104 be oriented and sized so that sealant is delivered not only into the crack 28, but also onto adjacent portions of the roadway. This preferred sealing action is facilitated because of the vehicle exhaust gases flowing through the pipe 116 and shroud 114. Such gases not only heat the emulsion as it is applied, but also generate a confining gas stream on opposite sides of the nozzle 104, thereby properly directing the sealant 142 into and on opposite sides of the crack 128. An additional effect is that the downwardly directed exhaust gases tend to blow away any loose gravel or the like around the crack.

As the apparatus 20 proceeds further along the length of crack 128, the finishing assembly 124 is encountered. At the finishing assembly, the brushes 210 smooth the upper layer of fill 40 to complete the crack sealing operation. The weight of the operator standing on platform plate 188 insures that the brushes adequately finish the seal. Also, this operator is in a position to observe the seal and advise the driver/operator or sideman if the seal is inadequate.

When a crack is completely sealed, the driver/operator shuts off the metering assembly 88 and closes valve 106 to terminate flow of sealant 42. Of course, when another crack is encountered, the above operation is repeated.

Figure 2:
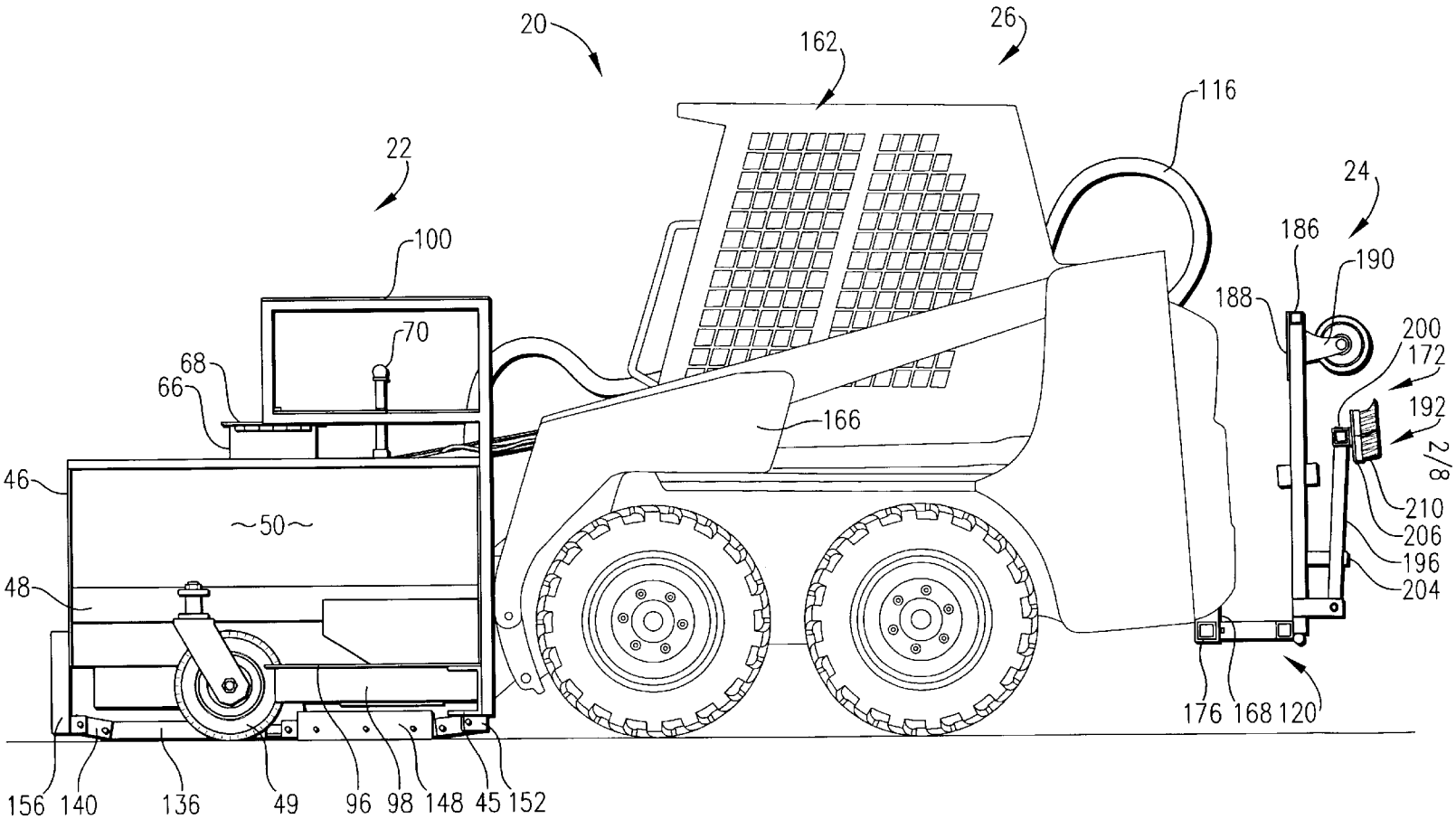
FIG. 2 is a side elevational view of the crack sealing apparatus depicted in FIG. 1, with the trailing broom assembly being in its retracted, travel position.

When a shift is completed or over the road travel required, the finishing assembly 24 may be readied by first removing the grab bar 214 and then pivoting the operator frame 172 upwardly to the retracted position of FIG. 2. Conventional clamps or the like (not shown) may be used to hold the operator frame in its upwardly pivoted, road travel position.

Figure 13:
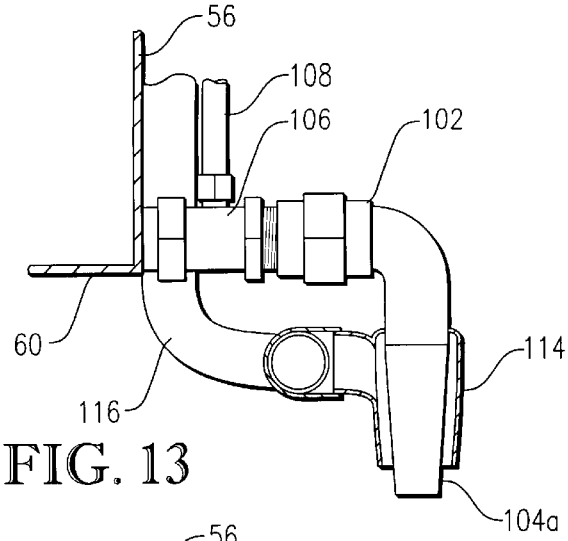
FIG. 13 is a view similar to that of FIG. 11, but showing the frustoconical nozzle of FIG. 12.
Figure 12:
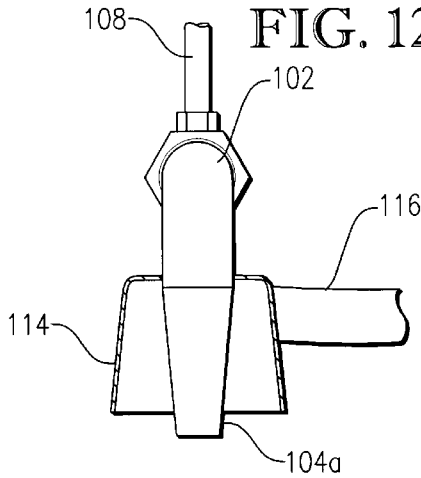
FIG. 12 is a side view similar to that of FIG. 10 but showing the use of a frustoconical delivery nozzle.

The nozzle 104 depicted in FIGS. 10 and 11 is exemplary of nozzles typically used. However, other types of nozzles, such as the frustoconical nozzle 104*a* illustrated in FIGS. 13 and 14, could also be used. Nozzle selection depends principally upon the depth and width of cracks encountered in a particular roadway. If desired, a spray mister for the spraying of soap solution onto the initial application of film material upstream of the sealant nozzle 104 can be provided; such a soap solution spray could also be provided as a part of the finishing assembly 24.

Actual operations with the preferred apparatus 20 has demonstrated that roadway crack sealing is greatly facilitated, being accomplished at significantly greater rates and at lower cost.

I claim:

1. A roadway crack sealing apparatus comprising:

an emulsion hopper;

an emulsion nozzle in fluid communication with said hopper, said emulsion nozzle presenting an expelling slit operable for expelling emulsion above the surface of a crack to be sealed and having a width greater than the width of the crack to be sealed when oriented transverse to the crack;

a nozzle heater; and, an emulsion containing frame in a spaced relationship with said nozzle, said frame including a pair of side rails with one of said pair of side rails being adjacent each end of said slit, said rails providing an emulsion-containing area within which emulsion expelled from said expelling slit is contained such that each side of the crack has a layer of emulsion thereon.

2. The crack sealing apparatus of claim 1, said nozzle heater comprising a heated air conduit at least partially surrounding said nozzle.

3. The crack sealing apparatus of claim 2, said apparatus including an engine and said heated air conduit being adapted for fluid connection with said engine.

4. The roadway crack sealing apparatus of claim 1, said apparatus further comprising:

a mobile vehicle having a driver compartment and a crack sealing assembly forward of said compartment, said sealing assembly including said emulsion hopper and a selectively openable emulsion outlet coupled with said emulsion hopper, said emulsion outlet comprising said emulsion nozzle; and said sealing assembly presenting spaced side margins and an elongated sighting passageway between said side margins, said passageway permitting an operator within said compartment to visually locate and follow an elongated roadway crack during forward movement of said vehicle along a roadway.

5. The apparatus of claim 4, said sealing assembly further including a fill hopper and a selectively openable fill outlet coupled with said fill hopper.

6. The apparatus of claim 5, including a control assembly operatively coupled with said fill and emulsion outlets, said control assembly including at least one operator-manipulable component permitting selective opening of the fill and emulsion outlets by the operator during said forward movement.

7. The apparatus of claim 6, said component being located adjacent said driver compartment.

8. The apparatus of claim 6, there being respective operator-manipulable components for selective opening of said fill outlet and said emulsion outlet.

9. The apparatus of claim 5, said fill hopper and said emulsion hopper being laterally spaced apart and astride said sighting passageway.

10. The apparatus of claim 5, there being a pair of spaced apart fill outlets coupled with said fill hopper, said emulsion outlet being located between said fill outlets.

11. The apparatus of claim 5, including a leveling element secured to said sealing assembly and oriented for leveling fill delivered from said fill outlet.

12. The apparatus of claim 11, said leveling element comprising a pair of elongated side rails and a plurality of spaced apart cross-rails secured to the side rails.

13. The apparatus of claim 12, including a pair of resilient drag members secured to said side rails rearwardly of said cross-rails.

14. The apparatus of claim 4, including a mirror positioned on said sealing assembly allowing said operator to see said roadway crack through said sighting passageway.

15. The apparatus of claim 5, including a forward platform secured to the sealing assembly and configured to allow a person to stand thereon, said platform located adjacent said fill hopper.

16. The apparatus of claim 4, including a finishing assembly rearward of said sealing assembly, said finishing assembly including a broom oriented for sweeping and finishing a roadway crack sealed by the sealing assembly during use of the apparatus.

17. The apparatus of claim 16, including a plurality of elongated brooms in staggered relationship.

18. The apparatus of claim 16, said finishing assembly including a rear platform configured to allow a person to stand thereon.

19. The apparatus of claim 4, said mobile vehicle being separable from said sealing assembly.

20. The apparatus of claim 19, said mobile vehicle being a skid steer vehicle.

21. The apparatus of claim 4, including a castered, roadway-engaging wheel supporting said sealing assembly.

22. The apparatus of claim 4, said vehicle having an exhaust port, there being a conduit extending from said exhaust port to a point adjacent said nozzle for heating of sealant delivered from the nozzle.

23. The apparatus of claim 1, said nozzle having width greater than the width of the common roadway crack whereby sealant is applied into said crack and onto the roadway on both sides of the crack.

24. The apparatus of claim 23, said nozzle having a width of from about 3–5 inches.

25. The apparatus of claim 1, said nozzle further comprising:

an elongated tubular body presenting an inflow port at a first end and an output port at an opposed second end and a channel therethrough in fluid communication with said inflow port and said outflow port;

said nozzle including support structure for orienting said nozzle in a spaced relationship above the crack to be filled; and said output port presenting a slit-like shape, said slit-like shape being wider than the crack to be sealed when said slit-like shape output port is oriented transverse to the crack to be sealed.

26. The apparatus of claim 25, said slit-shaped output port being between about 3–6 inches long.

27. A method of sealing an elongated roadway crack comprising the steps of:

providing a crack sealing apparatus according to claim 4;

driving said apparatus along said roadway, and guiding the apparatus by sighting said crack through said sighting passageway, and steering the vehicle to maintain sight of the crack through the passageway; and selectively opening said emulsion outlet during said driving and guiding steps to seal said crack.

28. The method of claim 27, said crack sealing apparatus further comprising a fill hopper and fill hopper outlet, said method further comprising the step of selectively opening said fill hopper outlet during said driving and guiding steps to fill said crack.

29. The method of claim 27, including the step of broom-sweeping the sealed crack subsequent to said opening step.

* * * * *